US009332861B2

(12) United States Patent
Borke

(10) Patent No.: US 9,332,861 B2
(45) Date of Patent: May 10, 2016

(54) CUTLERY DISPENSER AND METHODS OF USE

(71) Applicant: Dixie Consumer Products LLC, Atlanta, GA (US)

(72) Inventor: Brian Scott Borke, Appleton, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 169 days.

(21) Appl. No.: 13/969,901

(22) Filed: Aug. 19, 2013

(65) Prior Publication Data

US 2015/0048108 A1 Feb. 19, 2015

(51) Int. Cl.
*A47F 1/10* (2006.01)
*A47G 21/06* (2006.01)

(52) U.S. Cl.
CPC . *A47F 1/10* (2013.01); *A47G 21/06* (2013.01); *A47F 2001/103* (2013.01)

(58) Field of Classification Search
CPC ..... A47F 1/10; A47F 2001/103; A47G 21/06
USPC ..... 221/195; 30/147
See application file for complete search history.

(56) References Cited

U.S. PATENT DOCUMENTS

| | | | |
|---|---|---|---|
| 46,832 | A | 3/1865 | Thorpe |
| 592,105 | A | 10/1897 | Barnes |
| D32,913 | S | 6/1900 | Graf |
| 703,718 | A | 7/1902 | Cammann |
| 716,058 | A | 12/1902 | Laing et al. |
| 925,485 | A | 6/1909 | Lafler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |
| 1,355,583 | A | 10/1920 | Zeidler et al. |
| 1,482,071 | A | 1/1924 | Duff et al. |
| 1,497,585 | A | 6/1924 | Poole |
| 1,504,098 | A | 8/1924 | Cathey |
| 1,546,077 | A | 7/1925 | Hunter et al. |
| 1,547,151 | A | 7/1925 | Watling |
| 1,560,938 | A | 11/1925 | Lund |
| 1,577,302 | A | 3/1926 | Schltz |
| 1,610,001 | A | 12/1926 | Foster |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Peel Adhesion for Single Coated Pressure-Sensitive Tapes 180 Angle, Aug. 1989, pp. 21-22.

(Continued)

*Primary Examiner* — Michael K Collins

(57) ABSTRACT

A stack of disposable cutlery. The stack can include a plurality of disposable cutlery utensils disposed adjacent one another to provide a stack of the cutlery utensils. At least one elongated retaining mechanism can be adhered to the stack. The at least one elongated retaining mechanism can include at least one tail freely protruding beyond the stack.

23 Claims, 7 Drawing Sheets

(56) References Cited

U.S. PATENT DOCUMENTS 1,635,386 A 7/1927 Pierson
1,675,510 A 7/1928 Nolan
1,767,634 A 6/1930 Weiss
1,821,377 A 9/1931 Cusick
1,886,378 A 11/1932 George
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 erum
2,268,873 A 1/1942 Hopkins et al.
2,328,486 A 8/1943 Painter
2,340,561 A 2/1944 Renfro
2,401,534 A 6/1946 Welch
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,497,718 A 2/1950 Earley et al.
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,800,013 A 7/1957 George
2,806,634 A 9/1957 Baumgartner
2,824,369 A 2/1958 Welch
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,881,247 A 4/1959 Levine et al.
2,889,076 A 6/1959 Van Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 Du Bois
3,021,919 A 2/1962 Peters
3,037,257 A 6/1962 Girodet
3,052,006 A 9/1962 Jonas
3,054,528 A 9/1962 Loomis et al.
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,136,416 A * 6/1964 Goldrosen ..... B65D 73/0021 206/372
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,334,784 A 8/1967 Morrison
3,338,471 A 8/1967 Good
3,371,821 A 3/1968 Abood et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Albert
3,499,538 A 3/1970 Sherard
3,558,006 A 1/1971 Redmond et al.
3,587,922 A 6/1971 Oriti
3,593,908 A 7/1971 Desmond et al.
3,654,396 A 4/1972 Biezeveld
3,680,736 A 8/1972 Wiessmann
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,854,625 A 12/1974 Kuebler et al.
3,861,563 A 1/1975 Lisbin
3,862,702 A 1/1975 Johnson
3,897,886 A 8/1975 Franklin
3,932,978 A 1/1976 Kinney
3,944,128 A 3/1976 Hogan et al.
3,972,118 A 8/1976 Richard
3,987,901 A * 10/1976 Dullinger ..... B65C 9/10 206/451
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,271,999 A 6/1981 Stravitz
4,288,003 A 9/1981 Fries
4,308,974 A 1/1982 Jones
4,317,284 A 3/1982 Prindle
4,382,514 A 5/1983 Williams et al.
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson
4,614,004 A 9/1986 Oshida
4,624,616 A 11/1986 Freese et al.
4,638,921 A 1/1987 Sigl et al.
4,662,536 A 5/1987 Powers
4,666,037 A 5/1987 Weissman et al.
4,666,060 A 5/1987 Bouldin
4,676,504 A 6/1987 Ponza et al.
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal

(56) References Cited

U.S. PATENT DOCUMENTS 4,793,539 A 12/1988 Haenni et al.
4,835,864 A 6/1989 Tang
4,863,033 A 9/1989 Buj
4,884,718 A 12/1989 Leahy
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,961,684 A 10/1990 Provan et al.
4,963,072 A 10/1990 Miley et al.
RE33,447 E 11/1990 Rosman
4,973,037 A 11/1990 Holbrook
4,986,442 A 1/1991 Hinterreiter
4,989,730 A 2/1991 Lemoine et al.
4,995,154 A 2/1991 Bamber
5,012,927 A 5/1991 Borst et al.
D318,600 S 7/1991 Lillelund et al.
5,054,640 A 10/1991 Tucker et al.
5,054,649 A 10/1991 Lemaire et al.
5,064,093 A 11/1991 Davis et al.
5,080,257 A 1/1992 Carnisio
5,127,546 A 7/1992 Chen
5,131,586 A 7/1992 Capy
5,156,266 A 10/1992 Sykora et al.
5,161,268 A 11/1992 Harrow
5,176,494 A 1/1993 Nigrelli et al.
5,191,997 A 3/1993 Squitieri
5,199,756 A 4/1993 Bartlett et al.
5,211,267 A 5/1993 Clark
D336,047 S 6/1993 Kim
5,249,705 A 10/1993 Gates
5,263,596 A 11/1993 Williams
D342,648 S 12/1993 Cautereels et al.
5,269,397 A 12/1993 Kawamoto et al.
5,288,361 A 2/1994 Konno
5,305,875 A 4/1994 Meyer et al.
5,325,992 A 7/1994 Schmid et al.
5,327,650 A 7/1994 Rojas
D351,085 S 10/1994 Schmidt
5,353,935 A 10/1994 Yeager et al.
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,496,599 A * 3/1996 Schwartz ..... B29C 45/766 428/343
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A 12/1996 Bennett
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A * 12/1998 Nivin ..... A47G 21/06 30/147
5,853,092 A 12/1998 Goodman et al.
5,904,250 A * 5/1999 De Schutter ..... B65D 71/00 206/553
5,921,408 A 7/1999 Groenwold et al.
5,933,918 A 8/1999 Wallays
5,950,842 A 9/1999 Baur
5,961,021 A 10/1999 Koike et al.
D420,887 S 2/2000 Chen
6,023,908 A 2/2000 Vetsch
6,023,913 A 2/2000 Gray et al.
D422,431 S 4/2000 Goins
6,047,830 A 4/2000 Chang
6,062,424 A 5/2000 Simile-Gravina et al.
6,073,795 A 6/2000 Longstreth
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,495 B1 6/2001 Bando
6,250,498 B1 6/2001 Lovejoy
6,289,889 B1 9/2001 Bell et al.
6,298,960 B1 10/2001 Derr
6,336,568 B1 1/2002 Tucker et al.
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 9/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,945,427 B2 9/2005 Hieb
6,951,266 B2 10/2005 Tournier
6,972,033 B2 12/2005 McNicholas
6,976,348 B1 12/2005 Miano et al.
7,013,568 B2 3/2006 Schmidt
7,076,932 B2 * 7/2006 Rubin ..... B65B 11/00 53/137.2
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,204,406 B2 4/2007 Bone et al.
7,210,279 B1 5/2007 Ahmed et al.
7,237,700 B2 7/2007 Bulovic
7,249,793 B1 7/2007 Jabr et al.
7,258,233 B2 8/2007 Lee et al.
7,322,172 B2 1/2008 Hoffman et al.
7,325,376 B1 * 2/2008 DiNello ..... B65B 27/086 100/3
D564,819 S 3/2008 Fosburg et al.
7,412,808 B2 8/2008 Lavi
7,434,692 B2 10/2008 Ginsberg et al.
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 6/2010 Talmer et al.
7,819,234 B2 10/2010 Herzog
7,856,722 B2 12/2010 Lago-Arenas
D631,337 S 1/2011 Prevost
8,070,013 B2 12/2011 Reinsel et al.
8,083,058 B2 12/2011 Marcinkowski et al.
8,083,097 B2 12/2011 Kaufman et al.
8,152,004 B2 4/2012 Smith et al.
8,210,364 B2 * 7/2012 Smith ..... A47F 1/10 211/70.7
8,272,533 B1 * 9/2012 D'Amelia ..... A47F 1/10 221/172
8,296,957 B2 10/2012 Muehlemann
8,297,473 B2 10/2012 Smith
8,302,269 B2 11/2012 Pitman

(56) References Cited

U.S. PATENT DOCUMENTS

| | | | | |
|---|---|---|---|---|
| 8,360,273 | B2 | 1/2013 | Reinsel et al. | |
| 8,444,006 | B2 | 5/2013 | Dixon | |
| 8,480,954 | B2 | 7/2013 | Talmer et al. | |
| 8,776,379 | B2 * | 7/2014 | Walters | A47G 21/06 30/123 |
| 8,839,522 | B2 * | 9/2014 | Walters | B25G 1/10 30/142 |
| 8,844,798 | B2 | 9/2014 | Linkel | |
| 2001/0007308 | A1 | 7/2001 | Glassman et al. | |
| 2001/0025856 | A1 | 10/2001 | Lefevre Du Grosriez et al. | |
| 2002/0112445 | A1 | 8/2002 | Scaduto | |
| 2003/0015824 | A1 | 1/2003 | Forbes et al. | |
| 2003/0098344 | A1 | 5/2003 | Blake et al. | |
| 2003/0146061 | A1 | 8/2003 | Tournier | |
| 2004/0045398 | A1 | 3/2004 | Hayashi | |
| 2004/0045860 | A1 | 3/2004 | Edgerly et al. | |
| 2004/0089670 | A1 | 5/2004 | Goeking et al. | |
| 2004/0237311 | A1 | 12/2004 | Brown et al. | |
| 2005/0035136 | A1 | 2/2005 | Dathe et al. | |
| 2005/0082307 | A1 | 4/2005 | Tucker | |
| 2005/0116482 | A1 | 6/2005 | Harris et al. | |
| 2005/0155186 | A1 | 7/2005 | McGuyer et al. | |
| 2005/0155229 | A1 | 7/2005 | Lee | |
| 2005/0211722 | A1 | 9/2005 | Runnels | |
| 2005/0252057 | A1 | 11/2005 | Lavi | |
| 2006/0000190 | A1 | 1/2006 | Behnke et al. | |
| 2006/0042986 | A1 | 3/2006 | Simkowski et al. | |
| 2006/0053638 | A1 | 3/2006 | Sumner-Trivisani et al. | |
| 2006/0218795 | A1 | 10/2006 | Santa Cruz et al. | |
| 2006/0249531 | A1 | 11/2006 | Litchfield et al. | |
| 2007/0035943 | A1 | 2/2007 | Wang | |
| 2007/0108141 | A1 | 5/2007 | Smith et al. | |
| 2007/0131705 | A1 | 6/2007 | Behravesh et al. | |
| 2007/0193968 | A1 | 8/2007 | Smith et al. | |
| 2007/0214650 | A1 | 9/2007 | Tomazini | |
| 2007/0250391 | A1 | 10/2007 | Prade et al. | |
| 2008/0118609 | A1 | 5/2008 | Harlfinger et al. | |
| 2008/0121650 | A1 | 5/2008 | Smith | |
| 2008/0128445 | A1 | 6/2008 | Huang et al. | |
| 2008/0135569 | A1 | 6/2008 | Chan et al. | |
| 2009/0194557 | A1 | 8/2009 | Van Deursen | |
| 2010/0000096 | A1 | 1/2010 | Muehlemann | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 | 9/2011 | Reinsel et al. | |
| 2011/0266300 | A1 | 11/2011 | Schwarzli | |
| 2011/0296693 | A1 * | 12/2011 | Oakes | A47G 21/06 30/142 |
| 2012/0036724 | A1 | 2/2012 | Walters | |
| 2012/0047744 | A1 | 3/2012 | Walters | |
| 2012/0080444 | A1 | 4/2012 | Smith et al. | |
| 2012/0110746 | A1 | 5/2012 | Allard et al. | |
| 2012/0145734 | A1 * | 6/2012 | Walters | A47F 1/10 221/1 |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 * | 2/2013 | Oakes | A47F 1/125 221/279 |
| 2013/0126548 | A1 | 5/2013 | Pourian et al. | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0117036 | A1 | 5/2014 | Smith et al. | |
| 2014/0299656 | A1 | 10/2014 | Wintermute | |
| 2015/0028045 | A1 | 1/2015 | Oakes et al. | |
| 2015/0028046 | A1 | 1/2015 | Oakes et al. | |
| 2015/0041363 | A1 | 2/2015 | Freeman | |
| 2015/0041484 | A1 | 2/2015 | Oakes | |
| 2015/0048108 | A1 * | 2/2015 | Borke | A47F 1/10 221/195 |

FOREIGN PATENT DOCUMENTS

| | | | |
|---|---|---|---|
| CN | 101066183 | A | 11/2007 |
| CN | 101495015 | A | 7/2009 |
| DE | 7033238 | U | 11/1970 |
| DE | 7127677 | | 11/1971 |
| DE | 3151268 | A1 | 7/1983 |
| DE | 4139938 | A1 | 6/1993 |
| DE | 9316566 | U1 | 1/1994 |
| DE | 19906369 | C1 | 2/2000 |
| DE | 202005013647 | U1 | 7/2006 |
| EP | 0257109 | A1 | 8/1986 |
| EP | 0286538 | A1 | 10/1988 |
| EP | 0856272 | A3 | 1/1999 |
| EP | 1022107 | A1 | 7/2000 |
| EP | 1217923 | B1 | 9/2003 |
| EP | 1358827 | A2 | 11/2003 |
| EP | 1358827 | A3 | 3/2004 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | H06121727 | A | 5/1994 |
| JP | 08011934 | A | 1/1996 |
| JP | 08-047440 | | 2/1996 |
| JP | 08047440 | A | 2/1996 |
| JP | 3042582 | U | 10/1997 |
| JP | 09294662 | A | 11/1997 |
| JP | 2000-202851 | | 7/2000 |
| JP | 2000202851 | A | 7/2000 |
| JP | 2001354214 | A | 12/2001 |
| JP | 2004261336 | A | 9/2004 |
| JP | 2007319493 | A | 12/2007 |
| KR | 1991-0008085 | Y1 | 10/1991 |
| KR | 2019910008085 | | 10/1991 |
| KR | 10-2009-0071515 | A | 7/2009 |
| KR | 1020090071515 | A | 7/2009 |
| KR | 100954569 | B1 | 4/2010 |
| TW | M287639 | U | 2/2006 |
| TW | M293720 | U | 7/2006 |
| WO | 2004028309 | A1 | 4/2004 |
| WO | 2007049982 | A1 | 5/2007 |
| WO | 2009137367 | A2 | 11/2009 |

OTHER PUBLICATIONS

Tack Rolling Ball, Aug. 1989, pp. 29-30.
Holding Power of Pressure-Sensitive Tape, Aug. 1989, pp. 31-33.
European Patent Search Report EP 08 01 4387.8 dated Oct. 30, 2008.
European Patent Search Report EP 08 01 4387.8 dated Nov. 11, 2008, four pages, Germany.
European Search Report for 060009258.2, mailed Jul. 24, 2006, five mages, Munich, Germany.
International Search Report and Written Opinion for PCT/US2009/059915, Mailed Feb. 3, 2010, 13 pages, European Patent Office, Munich, Germany.
International Search Report and Written Opinion for PCT/US2011/044931, mailed Feb. 28, 2012.
International Search Report and Written Opinion for PCT/US2011/044934, mailed Mar. 6, 2012.
International Search Report and Written Opinion for PCT/US2011/058359.
International Search Report and Written Opinion for PCT/US2011/058767, dated Feb. 29, 2012.
International Search Report and Written Opinion for PCT/US2011/064057, dated Feb. 29, 2012.
PCT International Search Report and Written Opinion PCT/US2007/083752, Mar. 11, 2008, 10 pages.
PCT International Search Report PCT/US2007/083922 mailed Jul. 8, 2008, two pages.
PCT International Search Report PCT/US2007/083922 mailed Nov. 17, 2008, 10 pages.
Supplementary European Search Report dated Sep. 25, 2013 for Application No. 11793088.3 (20760).
Supplementary European Search Report for EP 11 79 3088 dated Sep. 25, 2013.

(56) References Cited

OTHER PUBLICATIONS

Written Opinion for PCT/US07/83752, mailed Mar. 11, 2008, six pages, European Patent Office, Munich, Germany.
International Search Report and Written Opinion for PCT/US2007/083922 mailed Nov. 17, 2008, 10 pages.
Partial International Search Report for PCT/US2007/083922, mailed Jul. 8, 2008, two pages.
European Search Report for EP 08 014 387.8, mailed Nov. 11, 2008, four pages, European Patent Office, Munich, Germany.
International Searching Authority, "International Search Report and Written Opinion for PCT/US2014/047463", mailed Nov. 26, 2014, 22 pages, Korean Intellectual Property Office, South Korea.
International Searching Authority, "International Search Report and Written Opinion for PCT/US2014/050166", mailed Nov. 20, 2014, 11 pages, Korean Intellectual Property Office, South Korea.
International Searching Authority, "International Search Report and Written Opinion for PCT/US2014/050169", mailed Jan. 9, 2015, 11 pages, Korean Intellectual Property Office, South Korea.
International Searching Authority, "International Search Report and Written Opinion for PCT/US2014/051632", mailed Dec. 3, 2014, 9 pages, Korean Intellectual Property Office, South Korea.
International Searching Authority, "International Search Report and Written Opinion for PCT/US2014/051639", mailed Dec. 9, 2014, 9 pages, Korean Intellectual Property Office, South Korea.
International Search Report and Written Opinion for PCT/US2010/000051, mailed Aug. 16, 2010, 6 pages.

* cited by examiner

CUTLERY DISPENSER AND METHODS OF USE

BACKGROUND

1. Field

Embodiments described generally relate to a cutlery dispenser. More particularly, such embodiments relate to a cutlery dispenser for dispensing cutlery utensils.

2. Description of the Related Art

Disposable cutlery is widely used at restaurants, sporting events, cafeterias, and social gatherings. Concerns of cost and hygiene often arise with the use of disposable cutlery. Providing disposable cutlery in a loose or unpackaged fashion can result in patrons taking more cutlery than necessary, thereby increasing unnecessary waste and costs. Loose or unpackaged cutlery can also cause concerns of hygiene and cleanliness. As a result, it can be desirable to dispense disposable cutlery in a manner other than in a loose or unpackaged fashion.

Enclosed dispensers have been a solution to such concerns and drawbacks. The cutlery utensils are typically loaded into a dispenser as a group or in a bundled stack. When loaded as a stack, a piece of cardboard or other stiff backing is often found on one side of the stack, and an adhesive strip, such as tape, is found on the other side. The combination of the cardboard and tape maintains the stacked arrangement until the utensils can be loaded within the dispenser.

The stack can shift prior to being inserted into the dispenser, breaking the uniform stacked arrangement. There is a need, therefore, for an improved support structure for disposable cutlery and methods for using same.

SUMMARY

A stack of disposable cutlery is disclosed. The stack can include a plurality of disposable cutlery utensils disposed adjacent one another to provide a stack of the cutlery utensils. At least one elongated retaining mechanism can be adhered to the stack. The at least one elongated retaining mechanism can include at least one tail freely protruding beyond the stack.

A cutlery dispenser is also disclosed. The dispenser can include a housing and a plurality of disposable cutlery utensils disposed adjacent one another to provide a stack of the cutlery utensils. At least one elongated retaining mechanism can be adhered to the stack. The at least one elongated retaining mechanism can include at least one tail freely protruding beyond the stack. At least one advancing mechanism can be disposed within the housing. The at least one advancing mechanism can be connected to the at least one elongated retaining mechanism and adapted to move the at least one elongated retaining mechanism within the housing, thereby releasing at least one of the cutlery utensils from the stack. An actuator can be connected to the at least one advancing mechanism and adapted to initiate the movement of the at least one advancing mechanism.

DETAILED DESCRIPTION

Figure 1:
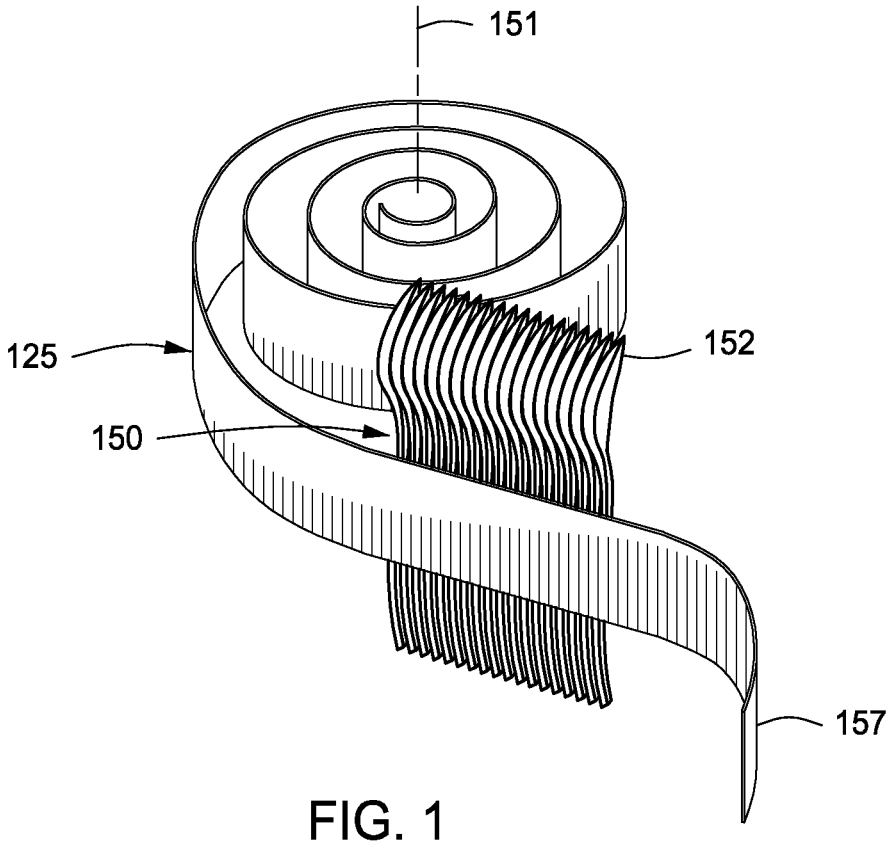
FIG. 1 shows a schematic view of an illustrative stack of utensils, according to one or more embodiments described.

FIG. 1 shows a schematic view of an illustrative stack 150 of utensils 152, according to one or more embodiments. The stack 150 can include at least one retaining mechanism 125 that is positioned or located adjacent one or more utensils 152. The retaining mechanism 125 can include an end portion or tail 157 that freely protrudes beyond the stack 150. The length of the tail 157 can vary and can range from about 1 mm, 2 mm, or 3 mm to about 10 mm, 20 mm, or 50 mm, for example.

The retaining mechanism 125 can be a single, continuous member or device, or it can be made of two or more components joined or otherwise pieced together. The retaining mechanism 125 can be elongated, such as a tape, strap, or band. An adhesive can be added substantially along at least one side or both sides of the retaining mechanism 125 to improve retention of the utensils 152 to the retaining mechanism 125.

The retaining mechanism 125 can be made from any number and types of materials. Preferably, the materials used to make the retaining mechanism 125 are flexible or pliable so the retaining mechanism 125 can be folded, wound, rolled, coiled, or otherwise manipulated to save space. Suitable material can be or include one or more elastomers, rubbers, papers, plastics, woven fibers, nonwoven fibers, metals, metal alloys, or any combination thereof.

The size and shape of the retaining mechanism 125 can depend on the number and size of utensils 152. For example, the length of the retaining mechanism 125 can range from about 10 cm, about 20 cm, about 30 cm, about 40 cm, or about 50 cm to about 75 cm, about 100 cm, about 150 cm, about 200 cm, about 500 cm, or more. The height of the retaining mechanism 125 can range from about 5 mm, about 7.5 mm, about 10 mm, about 12.5 mm, or about 15 mm to about 20 mm, about 30 mm, about 40 mm, about 50 mm, or more. The thickness of the retaining mechanism 125 can range from about 0.1 mm, about 0.2 mm, about 0.3 mm, about 0.4 mm, or about 0.5 mm to about 0.75 mm, about 1 mm, about 1.5 mm, about 2 mm, about 3 mm, or more.

The number of utensils 152 in the stack 150 can range from about 2, about 5, about 10, or about 20 to about 50, about 100, about 200, about 500, or more. As may be appreciated, the configuration of the stack 150 can depend, at least in part, on the size of the utensils 152, the shape of the utensils 152, the size of the housing 1410 (see FIG. 14), the shape of the housing 1410, or any combination thereof.

Figure 2:
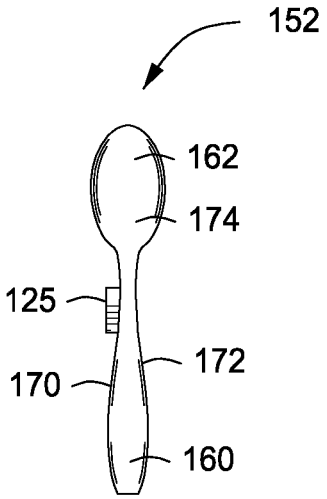
FIG. 2 shows an illustrative schematic view of a utensil with an elongated retaining mechanism positioned adjacent thereto, according to one or more embodiments described.

FIG. 2 shows a front view of one of the utensils 152 with the retaining mechanism 125 positioned adjacent thereto, according to one or more embodiments. Each utensil 152 can include a handle 160 and a head portion 162 that can be axially-offset from the handle 160. Each utensil 152 can have a first or "right" side 170, and a second or "left" side 172. The first and second sides 170, 172 are opposed to one another. Each utensil 152 can also have a third or "front" side 174 and a fourth or "back" side 176 (not shown). The front and back sides 174, 176 are shown opposed to one another. As depicted in FIG. 2, the retaining mechanism 125 can be positioned adjacent to and/or coupled to the first side 170. Alternatively, the retaining mechanism 125 can be positioned adjacent to and/or coupled to the second side 172, the front side 174, and/or the back side 176 of the utensils 152.

Each utensil 152 can be a spoon, fork, spork, knife, chop sticks, or any combination thereof. Within a given stack 150, the utensils 152 can all be the same, or the types of utensils 152 can vary in any frequency, pattern, or arrangement. For example, the stack 150 can include any number of forks (A), sporks (B), knives (C), chop sticks, etc, arranged in various patterns. Some illustrative patterns include, but are not limited to, A/B/C, or A/A/B/B/C/C, or A/B/C/A/B/C, or A/C/B, or B/C/A, etc. FIG. 2 depicts the utensil 152 as a spoon where the head portion 162 is a shallow bowl; however, as may be appreciated, the spoon is merely an illustrative utensil 152, and other utensils are contemplated.

Figure 3:
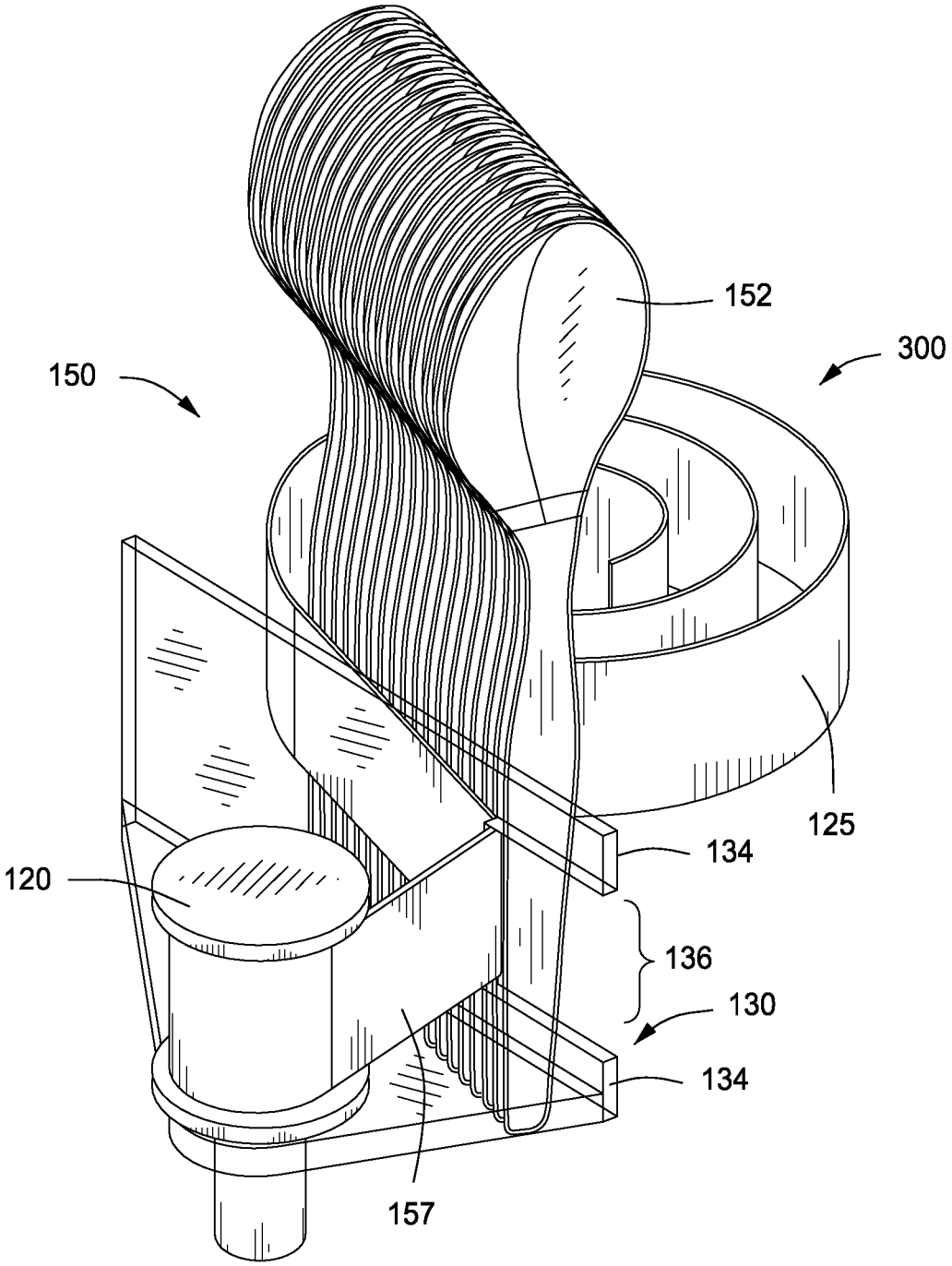
FIG. 3 depicts an illustrative schematic view of a dispensing assembly for use with the stack of FIG. 1.

FIG. 3 depicts an illustrative schematic view of a dispensing assembly 300 for use with the stack 150. At least one advancing mechanism 120 can be used to move or facilitate movement of the retaining mechanism 125. For example, the advancing mechanism 120 can be a spindle, shaft, roller, wheel, finger, or gripper-type device.

The tail 157 of the retaining mechanism 125 can be coupled or otherwise connected to the advancing mechanism 120. As the advancing mechanism 120 moves, the retaining mechanism 125 is pulled or drawn about the advancing mechanism 120 and neatly moved or stored out of the way of the stack of cutlery utensils 150. The terms "couple," "coupled," "connect," "connection," "connected," "in connection with," and "connecting" are used synonymously throughout, and intended to mean "direct connection with a part or thing" as well as "in connection with a part or thing via one or more other parts or things."

The dispensing assembly 300 can also include at least one separating device 130 for separating the utensils 152 from the retaining mechanism 125. The separating device 130 can include at least two axial protrusions 134 that form a window or opening 136 therebetween. The opening 136 can have a height that is greater than the height of the retaining mechanism 125 but less than the height of the utensils 152. The retaining mechanism 125 can pass through the opening 136 and collect or gather about the advancing mechanism 120. Due to the size of the opening 136, the separating device 130 can peel or otherwise separate the utensils 152 from the retaining mechanism 125 as the retaining mechanism 125 passes through the opening 136. Once separated from the retaining mechanism 125, the separated utensil 152 is free to fall into a tray or receptacle where it can be retrieved by a user from outside the dispenser, as explained in more detail below.

For simplicity and ease of description, the dispensing assembly 300 will be further described below with reference to a roller type advancing mechanism 120. In this specific embodiment, the advancing mechanism 120 can rotate about a central longitudinal axis, thereby pulling or drawing the retaining mechanism 125 and the utensils 152 toward the advancing mechanism 120.

Figure 4:
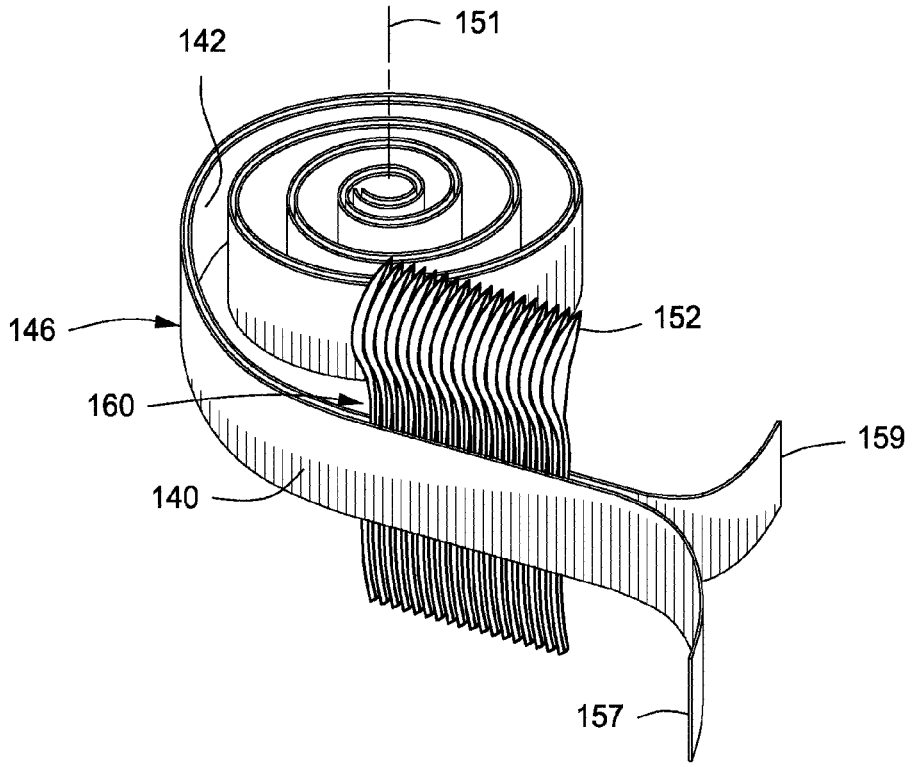
FIG. 4 shows a schematic view of another illustrative stack of utensils, according to one or more embodiments described.

FIG. 4 shows a schematic view of another illustrative stack 160 of utensils 152, according to one or more embodiments. The stack 160 can utilize an elongated retaining mechanism 146 that can have two parallel or generally parallel sides or portions 140, 142. The utensils 152 can be disposed, confined, or otherwise retained between the portions 140, 142 of the elongated retaining mechanism 146. The utensils 152 can be disposed, confined, or otherwise retained between the portions 140, 142 of the elongated retaining mechanism 146 by compression or friction. An adhesive can also be used to retain the utensils 152 between the portions 140, 142 of the elongated retaining mechanism 146. As discussed above, the elongated retaining mechanism 146 can be an adhesive tape or otherwise tacky band.

Once the utensils 152 are positioned adjacent to and/or adhered to the retaining mechanism 125, the utensils 152 and the retaining mechanism 146 can be rotated about the axis 151 to form the stack 150 in a spiral configuration, as shown in FIG. 4. The stack 150 can also be arranged in a winding or serpentine configuration (i.e., like the letter "S") such that the stack 150 includes two or more rows that are positioned adjacent to one another.

Figure 5:
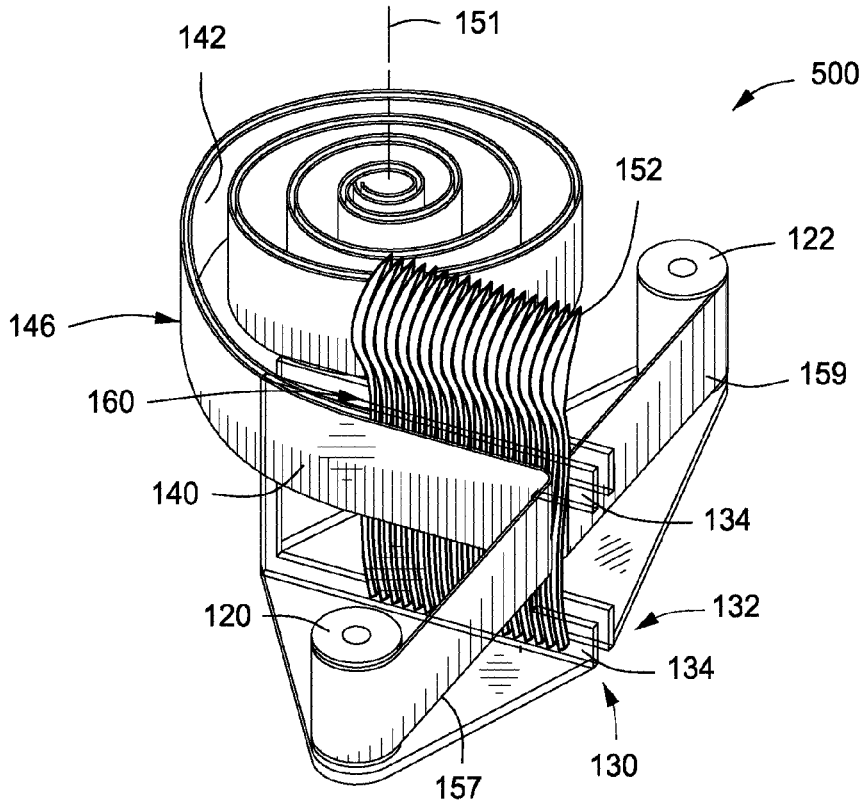
FIG. 5 shows a schematic view of an illustrative dispensing assembly for use with the stack of FIG. 4.

FIG. 5 shows a schematic view of an illustrative dispensing assembly 500 for use with the stack 160 of FIG. 4. The dispensing assembly 500 can include two or more advancing mechanisms or other pulling mechanisms 120, 122 for facilitating movement of the elongated retaining mechanism 146. A first tail 157 of the elongated retaining mechanism 146 can be coupled or otherwise disposed about one advancing mechanism 120 ("the first advancing mechanism" or "first pulling mechanism"), and a second tail 159 can be coupled or otherwise disposed about the other advancing mechanism 122 ("the second advancing mechanism" or "second pulling mechanism"). As the advancing mechanisms 120, 122 advance, pull, or otherwise move, the utensils 152 are released from the elongated retaining mechanism 146 one at a time. When the portions 140, 142 of the elongated retaining mechanism 146 are pulled in generally opposing directions, each portion 140, 142 of the elongated retaining mechanism 146 wraps around its respective advancing mechanism 120, 122 where it is stored neatly and out of the way.

One or more separating devices (two are shown 130, 132) can be used to guide or facilitate the separation of the utensils 152 from the elongated retaining mechanism 146. A first separating device 130 can be positioned proximate the first advancing mechanism 120 and/or the first portion 140 of the elongated retaining mechanism 146, and a second separating device 132 can be positioned proximate the second advancing mechanism 122 and/or the second portion 142 of the elongated retaining mechanism 146. Once separated from the elongated retaining mechanism 146, the separated utensil 152 is free to fall into a tray or receptacle where it can be retrieved by a user from outside the dispenser, as explained in more detail below.

Figure 6:
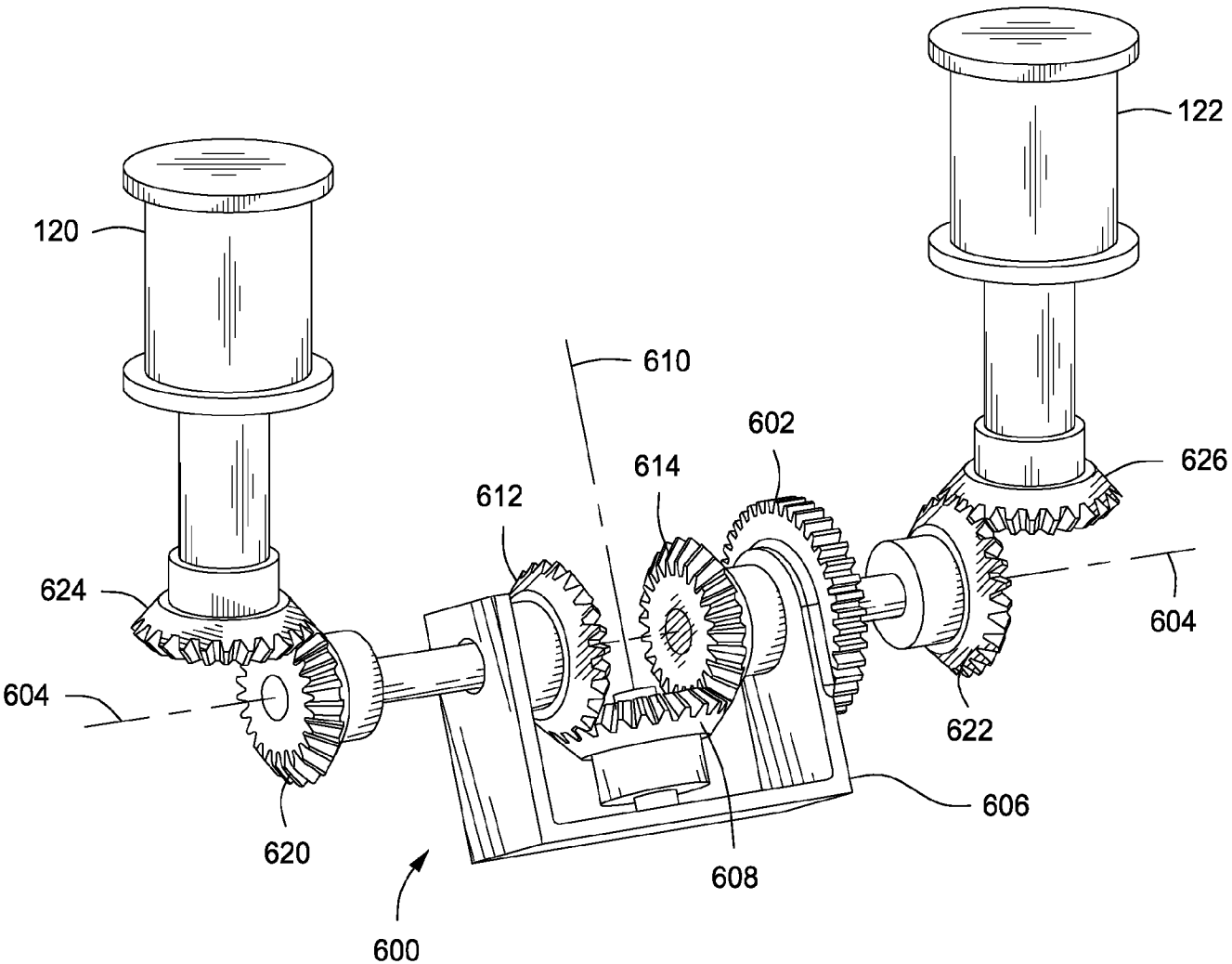
FIG. 6 shows a schematic view of an illustrative differential device for use with the dispensing assembly shown in FIG. 5.

FIG. 6 shows a schematic view of an illustrative differential device 600 for use with the dispensing assembly 500 shown in FIG. 5. The differential device 600 can include any suitable number of rotating gears (eight are shown 602, 608, 612, 614, 620, 622, 624, 626). Each gear 602, 608, 612, 614, 620, 622, 624, 626 can include a plurality of circumferentially offset teeth or protrusions that can engage the corresponding teeth of an adjoining or neighboring gear. In the configuration shown, the gear 602 and a bracket 606 can rotate together. This rotation causes the gear 608 to rotate, which, in turn, causes the gears 612, 614 to rotate. The rotation of the gears 612, 614 causes the gears 620, 622 to rotate. The rotation of the gear 620 causes the gear 624 to rotate, and the rotation of the gear 624 causes the first advancing mechanism 120 to rotate. Similarly, the rotation of the gear 622 causes the gear 626 to rotate, and the rotation of the gear 626 causes the second advancing mechanism 122 to rotate.

The size and/or number of teeth on one or more of the gears 612, 614, 620, 622, 624, 626 can vary. The size and/or number of teeth can dictate the torque and speed of the gears 612, 614, 620, 622, 624, 626. As such, the size and/or number of teeth can be varied to cause one advancing mechanism (e.g., advancing mechanism 120) to rotate and/or pull faster than the other advancing mechanism (e.g., advancing mechanism 122). It will be appreciated that other differential devices, including those having a different number or size of gears are also contemplated.

When the stack 160 (FIG. 5) has a spiral configuration, the first portion 140 of the elongated retaining mechanism 146 can be positioned radially-outward from the second portion 142 of the elongated retaining mechanism 146. As a result, the first portion 140 of the elongated retaining mechanism 146 can be longer than the second portion 142 of the elongated retaining mechanism 146. To accommodate this difference in length, the differential device 600 can cause the first advancing mechanism 120 to rotate and/or pull at a different rate (e.g., faster) than the second advancing mechanism 122. In another embodiment, the first advancing mechanism 120 can have a different (e.g., larger) cross-sectional length or diameter than the second advancing mechanism 122 to account for the longer first portion 140 of the elongated retaining mechanism 146. In yet another embodiment, each advancing mechanism 120, 122 can be controlled by a separate motor. In yet another embodiment, one or both advancing mechanisms 120, 122 can be coupled to a slip clutch or equivalent friction mechanism that allows the advancing mechanisms 120, 122 to compensate for differences in the length of the portions 140, 142 of the elongated retaining mechanism 146. Both advancing mechanisms 120, 122 can rotate and/or pull independently or together.

Figure 7:
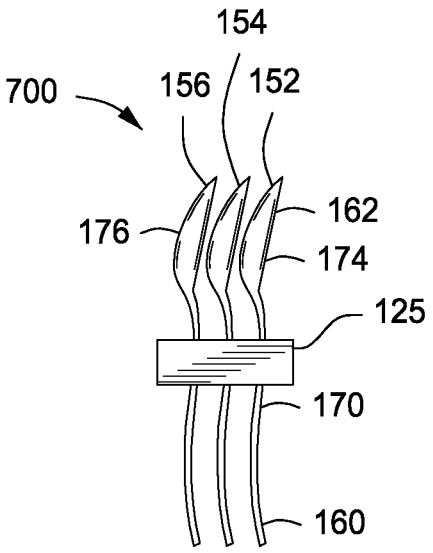
FIG. 7 shows a side view of a stack of utensils in a first illustrative configuration, according to one or more embodiments described.

FIG. 7 shows a side view of a stack 700 of utensils 152, 154, 156 in a first illustrative configuration, according to one or more embodiments. As depicted, the head portions 162 of the utensils 152, 154, 156 are aligned with one another. The front side 174 of each utensil 152, 154, 156 face (i.e., are oriented in) the same direction. The back side 176 of the first utensil 152 can be positioned adjacent the front side 174 of the second utensil 154. The back side 176 of the second utensil 154 can be positioned adjacent to the front side 174 of the third utensil 156, and so on. Thus, the head portions 162 of the utensils 152, 154, 156 can be nested.

The retaining mechanism 125 can be coupled to the first side 170 of the utensils 152, 154, 156 and/or the second side 172 of the utensils 152, 154, 156. Although not shown, the first portion 140 of the elongated retaining mechanism 146 can be coupled to the first side 170 of each utensil 152, 154, 156, and the second side 142 of the elongated retaining mechanism 146 (or a second band) can be coupled to the second side 172 of each utensil 152, 154, 156. The retaining mechanism 125 can be coupled to the handle 160 of the utensils 152, 154, 156 (as shown), the neck of the utensils 152, 154, 156, or to the head portion 162 (not shown).

More than one retaining mechanism 125 can be used and coupled to the first side 170 and/or the second side 172 of the utensils 152, 154, 156. A second elongated retaining mechanism (not shown) can be coupled to the first side 170 of the utensils 152, 154, 156 and axially-offset from the first retaining mechanism 125.

Figure 8:
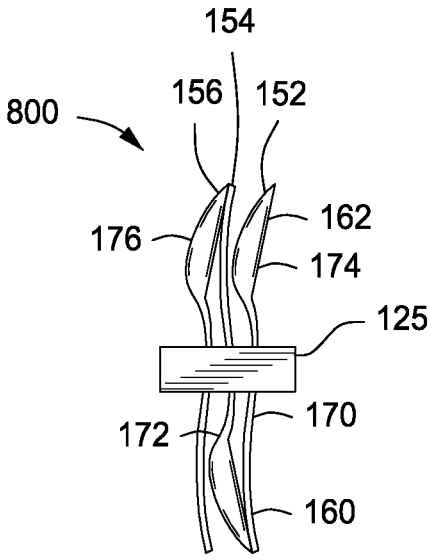
FIG. 8 shows a side view of a stack of utensils in a second illustrative configuration, according to one or more embodiments described.

FIG. 8 shows a side view of a stack 800 of utensils 152, 154, 156 in a second illustrative configuration, according to one or more embodiments. As depicted, the head portion 162 of each utensil 152, 154, 156 is axially opposed to the head portions 162 of the utensils 152, 154, 156 adjacent the front and back sides 174, 176 thereof. The head portion 162 of the second utensil 154 is axially opposed to the head portions 162 of the first and third utensils 152, 156. The head portion 162 of the third utensil 156 is axially opposed to the head portions 162 of the second and fourth utensils 154 (fourth utensil not shown), and so on.

As shown in FIG. 8, the front side 174 of each utensil 152, 154, 156 can face (i.e., be oriented in) the same direction. The back side 176 of the first utensil 152 can be positioned adjacent to the front side 174 of the second utensil 154. The back side 176 of the second utensil 154 can be positioned adjacent to the front side 174 of the third utensil 156, and so on. The retaining mechanism 125 can be coupled to the first side 170 of the first and third utensils 152, 156 and to the second side 172 of the second utensil 154. The retaining mechanism 125 can be coupled to the handle 160 of the utensils 152, 154, 156 (as shown) or to the head portion 162 (not shown).

Figure 9:
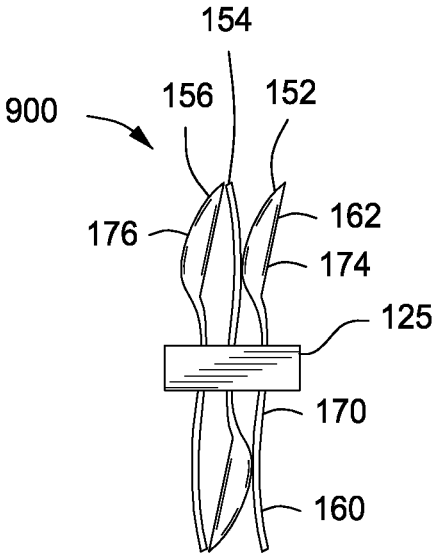
FIG. 9 shows a side view of a stack of utensils in a third illustrative configuration, according to one or more embodiments described.

FIG. 9 shows a side view of a stack 900 of utensils 152, 154, 156 in a third illustrative configuration, according to one or more embodiments. As depicted, the head portion 162 of each utensil 152, 154, 156 is axially opposed to the head portions 162 of the utensils 152, 154, 156 adjacent to the front and back sides 174, 176 thereof. The head portion 162 of the second utensil 154 is axially opposed to the head portions 162 of the first and third utensils 152, 156. The head portion 162 of the third utensil 156 is axially opposed to the head portions 162 of the second and fourth utensils 154 (fourth utensil not shown), and so on.

The front side 174 of each utensil 152, 154, 156 can face (i.e., be oriented in) a different direction than the front side 174 of the utensils 152, 154, 156 adjacent to the front and back sides 174, 176 thereof. The back side 176 of the first utensil 152 can be positioned adjacent to the back side 176 of the second utensil 154. The front side 174 of the second utensil 154 can be positioned adjacent to the front side 174 of the third utensil 156. The back side 176 of the third utensil 156 can be positioned adjacent to the back side 176 of a fourth utensil (not shown), and so on. The retaining mechanism 125 can be coupled to the first side 170 of each utensil 152, 154, 156. The retaining mechanism 125 can be coupled to the handle 160 of the utensils 152, 154, 156 (as shown) or to the head portion 162 (not shown).

Figure 10:
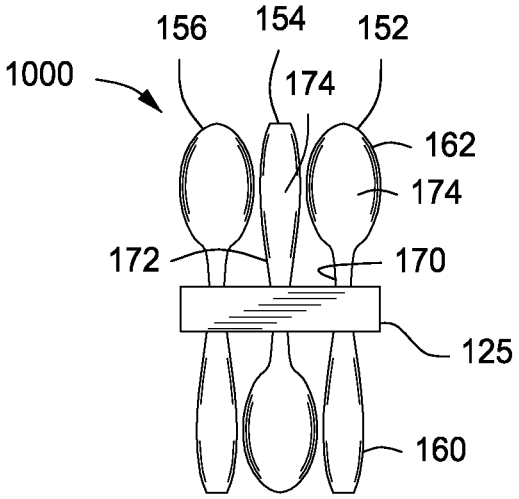
FIG. 10 shows a side view of a stack of utensils in a fourth illustrative configuration, according to one or more embodiments described.

FIG. 10 shows a side view of a stack 1000 of utensils 152, 154, 156 in a fourth illustrative configuration, according to one or more embodiments. As depicted, the head portion 162 of each utensil 152, 154, 156 is axially opposed to the head portions 162 of the utensils 152, 154, 156 adjacent to the first and second sides 170, 172 thereof. The head portion 162 of the second utensil 154 is axially opposed to the head portions 162 of the first and third utensils 152, 156. The head portion 162 of the third utensil 156 is axially opposed to the head portions 162 of the second and fourth utensils 154 (fourth utensil not shown), and so on.

The front side 174 of each utensil 152, 154, 156 can face (i.e., be oriented in) the same direction. The first side 170 of the first utensil 152 can be positioned adjacent the first side 170 of the second utensil 154. The second side 172 of the second utensil 154 can be positioned adjacent to the second side 172 of the third utensil 156. The first side 170 of the third utensil 156 can be positioned adjacent to the first side 170 of a fourth utensil (not shown); and so on. The retaining mechanism 125 can be coupled to the front side 174 of each utensil 152, 154, 156. The retaining mechanism 125 can be coupled to the handle 160 of the utensils 152, 154, 156 (as shown) or to the head portion 162 (not shown).

Figure 11:
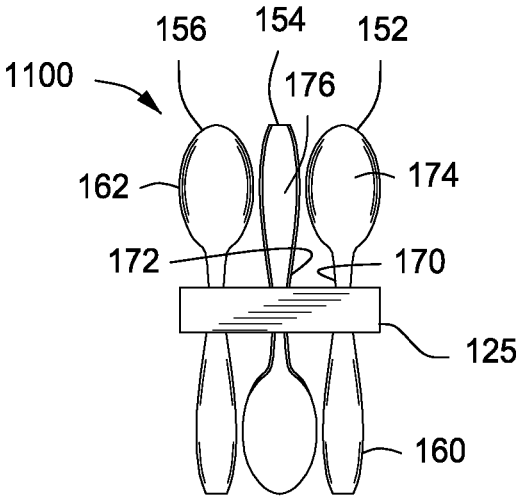
FIG. 11 shows a side view of a stack of utensils in a fifth illustrative configuration, according to one or more embodiments described.

FIG. 11 shows a side view of a stack 1100 of utensils 152, 154, 156 in a fifth illustrative configuration, according to one or more embodiments. As depicted, the head portion 162 of each utensil 152, 154, 156 is axially opposed to the head portions 162 of the utensils 152, 154, 156 adjacent the first and second sides 170, 172 thereof. The head portion 162 of the second utensil 154 is axially opposed to the head portions 162 of the first and third utensils 152, 156. The head portion 162 of the third utensil 156 is axially opposed to the head portions 162 of the second and fourth utensils 154 (fourth utensil not shown), and so on.

In addition, the front side 174 of each utensil 152, 154, 156 can face (i.e., be oriented in) a different direction than the front side 174 of the utensils 152, 154, 156 adjacent the first and second sides 170, 172 thereof. The first side 170 of the first utensil 152 can be positioned adjacent the second side 172 of the second utensil 154. The first side 170 of the second utensil 154 can be positioned adjacent to the second side 172 of the third utensil 156. The first side 170 of the third utensil 156 can be positioned adjacent to the second side 172 of a fourth utensil (not shown), and so on. The retaining mechanism 125 can be coupled to the front side 174 of the first and third utensils 152, 156 and/or to the back side 172 of the second utensil 154. The retaining mechanism 125 can be coupled to the handle 160 of the utensils 152, 154, 156 (as shown) or to the head portion 162 (not shown).

With reference to FIGS. 7-11, the head portion 162 of each utensil (e.g., the first and third utensils 152, 156) can be axially offset from the end portions of the handles 160 of the utensils (e.g., the second utensil 154) positioned adjacent to the first and second sides 170, 172 thereof. This can increase the number of utensils 152, 154, 156 that can be included per unit length of the retaining mechanism 125 because the head portions 162 of the first and third utensils 152, 156 can be positioned closer together.

Figure 12:
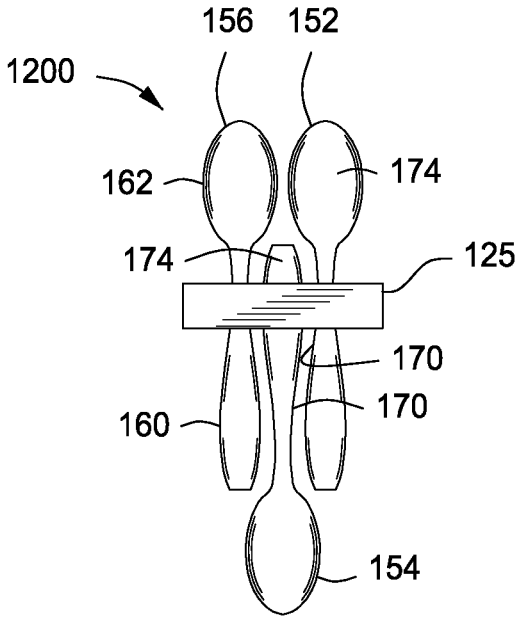
FIG. 12 shows a side view of a stack of utensils in a sixth illustrative configuration, according to one or more embodiments described.

FIG. 12 shows a side view of a stack 1200 of utensils 152, 154, 156 in a sixth illustrative configuration, according to one or more embodiments. The stack 1200 in the sixth configuration is similar to the stack 1000 in the fourth configuration (see FIG. 10). However, as depicted, the head portion 162 of each utensil 152, 154, 156 is axially offset from the end portions of the handles 160 of the utensils 152, 154, 156 adjacent to the first and second sides 170, 172 thereof. The head portion 162 of each utensil (e.g., the second utensil 154) extends beyond the end portions of the handles 160 of the utensils (e.g., the first and third utensils 152, 156) adjacent to the first and second sides 170, 172 thereof.

Figure 13:
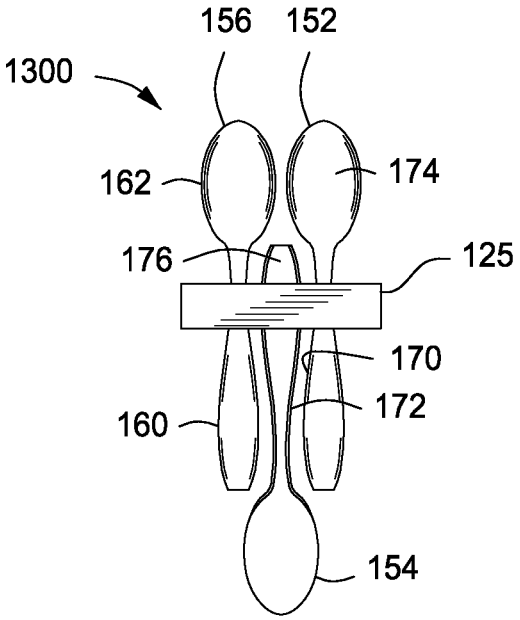
FIG. 13 shows a side view of a stack of utensils in a seventh illustrative configuration, according to one or more embodiments described.

FIG. 13 shows a side view of a stack 1300 of utensils 152, 154, 156 in a seventh illustrative configuration, according to one or more embodiments. The stack 1300 in the seventh configuration is similar to the stack 1100 in the fifth configuration (see FIG. 11). However, as depicted, the head portion 162 of each utensil 152, 154, 156 is axially offset from the end portions of the handles 160 of the utensils 152, 154, 156 adjacent to the first and second sides 170, 172 thereof. The head portion 162 of each utensil (e.g., the second utensil 154) extends beyond the end portions of the handles 160 of the utensils (e.g., the first and third utensils 152, 156) adjacent to the first and second sides 170, 172 thereof.

As evident from FIGS. 12 and 13, the number of utensils 152, 154, 156 that can be included per unit length of the retaining mechanism 125 can be increased by positioning the head portion 162 of a utensil (e.g., the second utensil 154) axially beyond the end portions of the handles 160 of the utensils (e.g., the first and third utensils 152, 156) on either side thereof. This is because the handle 160 of each utensil (e.g., the second utensil 154) is not positioned between the head portions 162 of the utensils (e.g., the first and third utensils 152, 156) positioned adjacent to the first and second sides 170, 172 thereof, which allows the head portions 162 of the first and third utensils 152, 156 to be positioned closer together.

Figure 14:
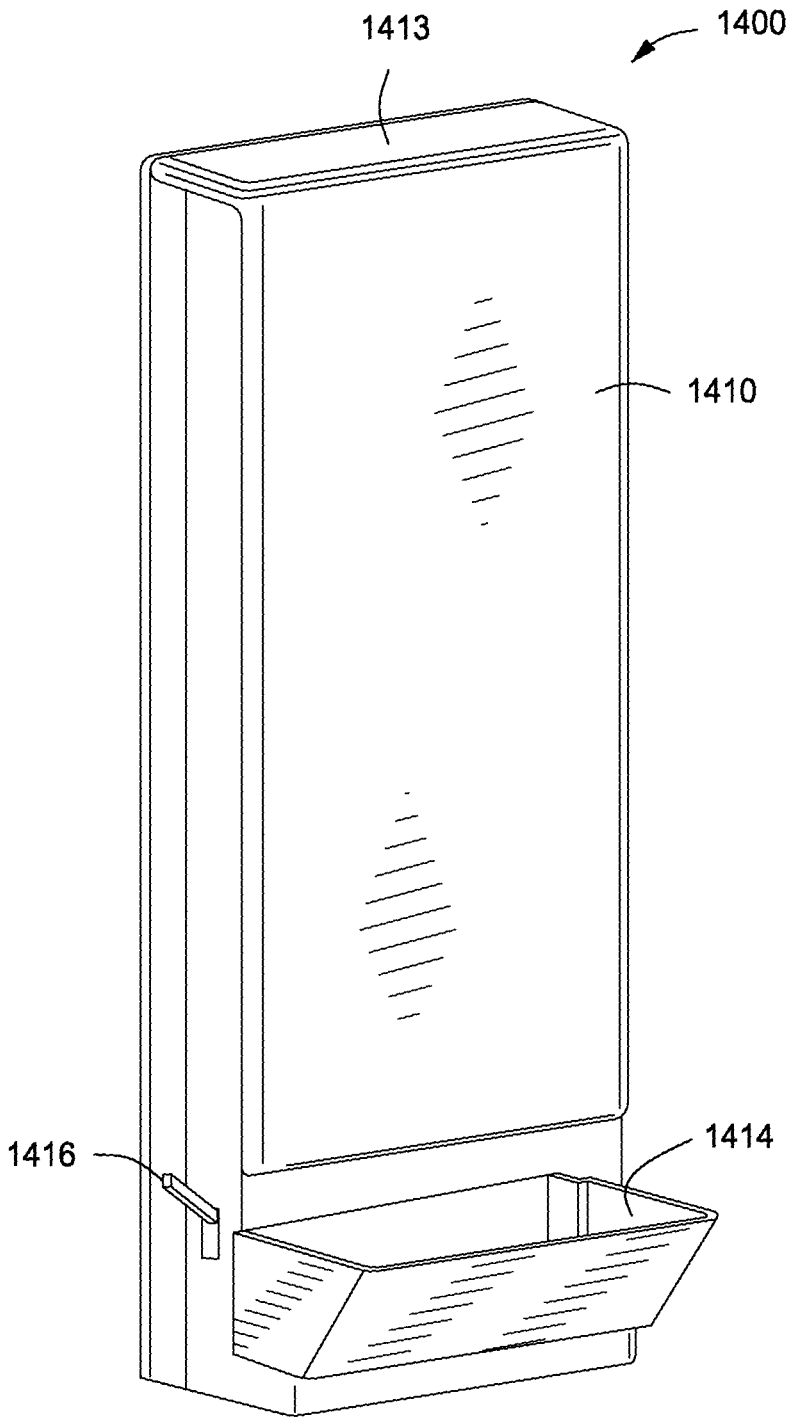
FIG. 14 shows a perspective view of an illustrative dispenser having the stack disposed therein, according to one or more embodiments described.

FIG. 14 shows a perspective view of an illustrative dispenser 1400 for dispensing utensils, according to one or more embodiments. The dispenser 1400 includes a housing 1410 in which the stack 150 of utensils 152 can be loaded and/or stored. The dispenser 1410 can also include one or more openings to provide a path of communication between the interior of the housing 1410 and the exterior of the housing 1410. A first opening 1413 can be used to insert or load the stack 150 of utensils 152 into the housing 1410, and a second opening (tray or receptacle) 1414 can be used to distribute or dispense the utensils 152 from the housing 1410 to a user.

The housing 1410 can also include one or more actuators (one is shown 1416) which can be disposed at least partially on an exterior thereof. In another embodiment, the actuator 1416 can be disposed inside the housing 1410. The actuator 1416 can be coupled to one or both advancing mechanisms 120, 122 and adapted to cause one or both advancing mechanisms 120, 122 to rotate. The actuator 1416 can be coupled to both advancing mechanisms 120, 122 via the differential 600 and adapted to cause both advancing mechanisms 120, 122 to rotate and/or pull together. In another example, a first actuator 1416 can be coupled to the first advancing mechanism 120 and cause the first advancing mechanism 120 to rotate and/or pull, and a second actuator (not shown) can be coupled to the second advancing mechanism 122 and cause the second advancing mechanism 122 to rotate and/or pull independently of the first advancing mechanism 120. The actuator 1416 can be or include a handle, a rotatable knob, a button, a switch, a bar, an electric sensor, a motor, a crank, or the like. As discussed above, the rotation and/or pulling of the advancing mechanisms 120, 122 causes the retaining mechanism 125 to release one or more of the utensils 152 at a time, as described above, so that the utensils 152 can be withdrawn from the housing 1410 through the second opening 1414.

In operation, the utensils 152 can be coupled to the retaining mechanism 125 to form the stack 150, as shown in FIGS. 1-3. Once the stack 150 is assembled, the stack 150 can be loaded into the housing 1410. The stack 150 can be loaded into the housing 1410 in the spiral configuration, as shown in FIG. 3, in a winding configuration, or in any other suitable configuration. The tail 157 of the retaining mechanism 125 can be coupled to the advancing mechanism 120. When a user desires a utensil 152, the user can push, pull, rotate, or otherwise actuate/trigger the actuator 1416, which causes the advancing mechanism 120 to rotate. When the advancing mechanism 120 rotates, the advancing mechanism 120 pulls the retaining mechanism 125. The separating device 130 can separate the first utensil 152 from the retaining mechanism 125, thereby allowing the first utensil 152 to be received by the user through the opening 1414 in the housing 1410.

In another embodiment, the utensils 152 can be coupled to and/or disposed between the portions 140, 142 of the elongated retaining mechanism 146 to form the stack 160, as shown in FIGS. 4 and 5. Once the stack 160 is assembled, the stack 160 can be loaded into the housing 1410. The stack 160 can be loaded into the housing 1410 in the spiral configuration, as shown in FIG. 5, in a winding configuration, or in any other suitable configuration. The tail 157 of the first portion 140 of the elongated retaining mechanism 146 can be coupled to the first advancing mechanism 120, and the tail 159 of the second portion 142 of the elongated retaining mechanism 146 can be coupled to the second advancing mechanism 122. When a user desires a utensil 152, the user can push, pull, rotate, or otherwise actuate/trigger the actuator 1416, which causes one or both advancing mechanisms 120, 122 to rotate. When the advancing mechanisms 120, 122 rotate, the advancing mechanisms 120, 122 pull the elongated retaining mechanism 146. The separating devices 130, 132 can separate the first utensil 152 from the elongated retaining mechanism 146, thereby allowing the first utensil 152 to be received by the user through the opening 1414 in the housing 1410.

The utensils 152 can be released from the retaining mechanism 125, 146 one at a time. The number of revolutions of the first and/or second advancing mechanisms 120, 122 can dictate when a utensil 152 is released from the retaining mechanism 125, 146. The first utensil 152 can be released after the first and/or second advancing mechanisms 120, 122 are rotated one revolution, a second utensil 154 can be released after the first and/or second advancing mechanisms 120, 122 are rotated a second revolution, and so on. However, as may be appreciated, the number of revolutions of the advancing mechanisms 120, 122 required to release the utensils 152 can vary. Each utensil 152 can be released after the first and/or second advancing mechanisms 120, 122 are rotated from about 1/16 revolution, about 1/12 revolution, about 1/8 revolution, about 1/4 revolution, or about 1/2 revolution to about 1 revolution, about 2 revolutions, about 3 revolutions, about 4 revolutions, about 5 revolutions, or more. In addition, the number of revolutions required to release the first utensil 152 can be different than the number of revolutions required to release the second utensil 154, and so on.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof is determined by the claims that follow.

What is claimed is:

1. A stack of disposable cutlery, comprising:

a plurality of disposable cutlery utensils disposed adjacent one another to provide a stack of the cutlery utensils, wherein the stack is oriented in a non-linear configuration;

at least one first elongated retaining mechanism adhered to a first side of the stack, wherein the first elongated retaining mechanism comprises a first tail freely protruding beyond the stack; and at least one second elongated retaining mechanism adhered to a second side of the stack, wherein the second elongated retaining mechanism comprises a second tail freely protruding beyond the stack, and wherein the first tail and the second tail are configured to be moved in opposing directions to release one cutlery utensil at a time from the stack, wherein the elongated retaining mechanisms comprise an adhesive disposed on at least one side thereof to contact and adhere the elongated retaining mechanisms to their respective side of the stack.

2. The stack of claim 1, wherein the at least one first elongated retaining mechanism comprises an adhesive disposed substantially along at least one side thereof.

3. The stack of claim 1, wherein the cutlery utensils are selected from the group consisting of a fork, a knife, a spoon, a spork, and combinations thereof.

4. The stack of claim 1, wherein the stack is oriented in a spiral configuration.

5. The stack of claim 1, wherein the stack is oriented in a winding configuration.

6. The stack of claim 1, wherein a head portion of a first one of the cutlery utensils is axially aligned with a head portion of a second one of the cutlery utensils, wherein the head portions of the first and second cutlery utensils are oriented in the same direction, and wherein a back side of the first cutlery utensil is positioned adjacent to a front side of the second cutlery utensil.

7. The stack of claim 1, wherein a head portion of a first one of the cutlery utensils is axially opposed to a head portion of a second one of the cutlery utensils, wherein the head portions of the first and second cutlery utensils are oriented in the same direction, and wherein a first side of the first cutlery utensil is positioned adjacent to a second, opposing side of the second cutlery utensil.

8. The stack of claim 1, wherein a head portion of a first one of the cutlery utensils is axially opposed to a head portion of a second one of the cutlery utensils, wherein the head portions of the first and second cutlery utensils are oriented in opposing directions, and wherein a first side of the first cutlery utensil is positioned adjacent to a corresponding first side of the second cutlery utensil.

9. The stack of claim 1, wherein all of the disposable cutlery utensils in the stack of cutlery utensils are disposed between the first elongated retaining mechanism and the second elongated retaining mechanism.

10. A cutlery dispenser, comprising:

a housing;

a plurality of disposable cutlery utensils disposed adjacent one another to provide a stack of the cutlery utensils;

at least one elongated retaining mechanism adhered to the stack, wherein the at least one elongated retaining mechanism comprises at least one tail freely protruding beyond the stack, and wherein the elongated retaining mechanism comprises an adhesive disposed on at least one side thereof to adhere the elongated retaining mechanism to a side of the stack;

at least one advancing mechanism disposed within the housing, the at least one advancing mechanism being connected to the at least one elongated retaining mechanism and adapted to move the at least one elongated retaining mechanism within the housing, thereby releasing at least one of the cutlery utensils from the stack; and an actuator connected to the at least one advancing mechanism and adapted to initiate the movement of the at least one advancing mechanism.

11. The cutlery dispenser of claim 10, wherein the tail is connected to the at least one advancing mechanism, and wherein the movement of the at least one advancing mechanism pulls the tail and wraps the tail thereabout.

12. The cutlery dispenser of claim 10, further comprising a separating device positioned adjacent the at least one advancing mechanism for separating the one of the cutlery utensils from the at least one elongated retaining mechanism.

13. The cutlery dispenser of claim 12, wherein the separating device comprises two axial protrusions defining a window therebetween.

14. The cutlery dispenser of claim 10, wherein the at least one elongated retaining mechanism comprises an adhesive disposed on at least one side thereof.

15. The cutlery dispenser of claim 10, wherein the cutlery utensils are selected from the group consisting of a fork, a knife, a spoon, a spork, and combinations thereof.

16. The cutlery dispenser of claim 10, wherein:

the at least one elongated retaining mechanism comprises at least one first elongated retaining mechanism adhered to a first side of the stack and at least one second elongated retaining mechanism adhered to a second side of the stack, the first elongated retaining mechanism comprises a first tail freely protruding beyond the stack, the second elongated retaining mechanism comprises a second tail freely protruding beyond the stack, and the first tail and the second tail move in opposing directions to release one cutlery utensil at a time from the stack, wherein the elongated retaining mechanisms comprise an adhesive disposed on at least one side thereof to adhere the elongated retaining mechanisms to their respective side of the stack.

17. The cutlery dispenser of claim 10, wherein the stack is oriented in a spiral configuration.

18. A cutlery dispenser, comprising:

a housing;

a plurality of disposable cutlery utensils disposed adjacent one another to provide a stack of the cutlery utensils;

at least one elongated retaining mechanism adhered to the stack, wherein the at least one elongated retaining mechanism comprises at least one tail freely protruding beyond the stack, and wherein the elongated retaining mechanism comprises an adhesive disposed on at least one side thereof to adhere the elongated retaining mechanism to a side of the stack;

at least one advancing mechanism disposed within the housing, the at least one advancing mechanism being connected to the at least one elongated retaining mechanism and adapted to move the at least one elongated retaining mechanism within the housing, thereby releasing at least one of the cutlery utensils from the stack;

an actuator connected to the at least one advancing mechanism and adapted to initiate the movement of the at least one advancing mechanism; and a differential device coupled to both the at least one advancing mechanism and the actuator, wherein the differential device comprises a plurality of rotating gears.

19. The cutlery dispenser of claim 18, wherein the tail is connected to the at least one advancing mechanism, and wherein the movement of the at least one advancing mechanism pulls the tail and wraps the tail thereabout.

20. The cutlery dispenser of claim 18, further comprising a separating device positioned adjacent the at least one advancing mechanism for separating the one of the cutlery utensils from the at least one elongated retaining mechanism, wherein the separating device comprises two axial protrusions defining a window therebetween.

21. The cutlery dispenser of claim 18, further comprising an adhesive disposed on at least one side of the at least one retaining mechanism.

22. The cutlery dispenser of claim 18, wherein:

the at least one elongated retaining mechanism comprises at least one first elongated retaining mechanism adhered to a first side of the stack and at least one second elongated retaining mechanism adhered to a second side of the stack, the first elongated retaining mechanism comprises a first tail freely protruding beyond the stack, the second elongated retaining mechanism comprises a second tail freely protruding beyond the stack, and the first tail and the second tail move in opposing directions to release one cutlery utensil at a time from the stack, wherein the elongated retaining mechanisms comprise an adhesive disposed substantially along at least one side thereof to adhere the elongated retaining mechanisms to their respective side of the stack.

23. The cutlery dispenser of claim 18, wherein the stack is oriented in a spiral configuration.

* * * * *